United States Patent [19]

McCoy, Jr.

[11] 4,352,384

[45] Oct. 5, 1982

[54] SLATTED WINDOW INSULATING INSERT

[76] Inventor: Oval O. McCoy, Jr., 4204 Manila, Jonesboro, Ark. 72401

[21] Appl. No.: 255,509

[22] Filed: Apr. 20, 1981

[51] Int. Cl.[3] ..... E06B 9/30

[52] U.S. Cl. ..... 160/172; 160/232; 160/236

[58] Field of Search ..... 160/107, 166, 168, 172, 160/232, 236; 49/69, 74, 75, 371, 398

[56] References Cited

U.S. PATENT DOCUMENTS

| | | | |
|---|---|---|---|
| 2,203,934 | 6/1940 | Wiles | 49/75 |
| 2,378,591 | 6/1945 | Solis | 160/236 |
| 2,524,373 | 10/1950 | Bopp et al. | 160/166 A |
| 2,717,034 | 9/1955 | Sharpe | 160/166 A |
| 2,855,039 | 10/1958 | Gross | 160/236 |
| 2,861,836 | 11/1958 | Goeggel | 49/75 |
| 3,151,665 | 10/1964 | Stack | 160/236 |
| 3,234,996 | 2/1966 | King et al. | 160/232 |
| 3,280,891 | 10/1966 | Eldredge, Jr. et al. | 160/172 |
| 3,921,694 | 11/1975 | Galex | 160/172 |
| 4,292,763 | 10/1981 | Barnes et al. | 49/64 |

*Primary Examiner*—Peter M. Caun

*Attorney, Agent, or Firm*—Stephen D. Carver

[57] ABSTRACT

A multiple slat insert adapted to be installed in window fixtures operable when in a closed position to insulate the window and, when in an open position, to expose the window. The insert preferably comprises a pair of elongated, spaced-apart mounting members secured within the window frame, and a plurality of elongated, generally planar slats rotatably coupled between the mounting members. The slats are of parallelogram cross section, so that when rotated to the closed, generally co-planar position, they will abut one another to provide a convective seal.

1 Claim, 11 Drawing Figures

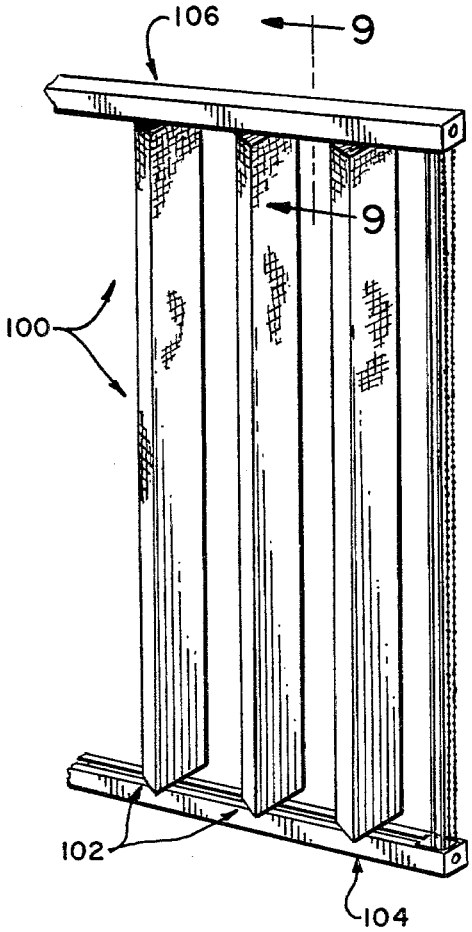
FIG. 8
FIG. 9
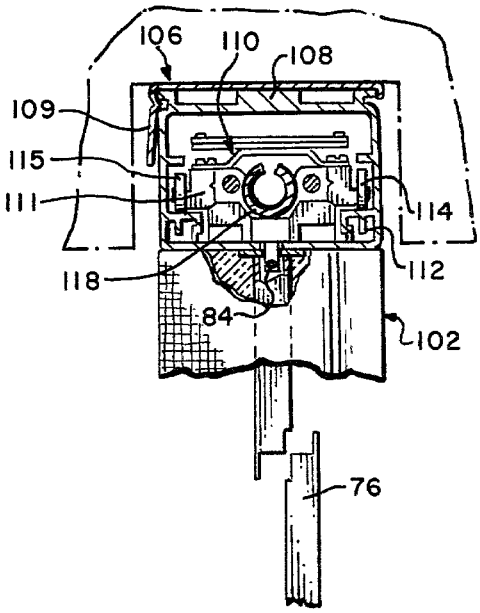
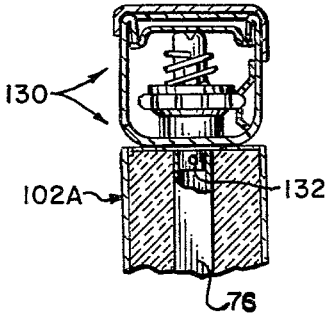
FIG. 10
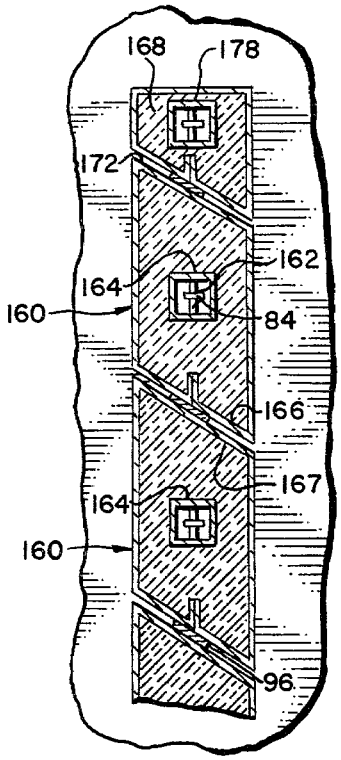
FIG. 11

SLATTED WINDOW INSULATING INSERT

BACKGROUND OF THE INVENTION

The present invention relates generally to a thermal insulating system for windows. More particularly, the present invention is related to a system adapted to be employed in conjunction with conventional windows which may be switched between light admitting and light blocking, insulative positions. U.S. Classes 88, 160 and 350 are deemed most relevant.

While window fixtures are aesthetically desirable for both residential and commercial buildings, it will be readily appreciated by those skilled in the art that heating and cooling losses caused by windows are extreme. The "R" factor of a single pane window, for example, is approximately one. Double windows may reach an "R" factor or between two and three. This is very poor compared to the "R" factor of a windowless, insulated wall, the characteristic "R" factor of which may vary between eight and twenty depending upon wall thickness and other variables.

Typical window fixtures readily transmit heat, light, and radiant energy. However, window panes are extremely conductive and heat is lost in that manner as well. Loosely fitted windows, particularly where adjustable windows are concerned, experience convective losses.

In the prior art a variety of window blinds or window slat systems are known. A basic venetian blind system is illustrated in U.S. Pat. No. 2,103,271. More sophisticated screen or blind systems; some of which are concerned with the control or energy losses, may be seen in the following U.S. Pat. Nos. 3,946,788; 4,019,554; 1,639,474; and 3,472,305; and 3,443,860. Related devices may be seen in U.S. Pat. Nos. 2,952,312 and 2,804,137. Folding structures employed in conjunction with energy transfer are illustrated in U.S. Pat. Nos. 2,310,086 and 3,048,375. The latter patent teaches that a plurality of slates may be moved between open and closed positions to variably effect energy transmission.

SUMMARY OF THE INVENTION

The present invention comprises a window insert adapted to be employed in conjunction with conventional residential or business windows or window fixtures. The insert preferably comprises a pair of elongated, spaced-apart mounting members, between which a plurality of cooperating, insulative slats are pivotally disposed. The slats may be moved between an "open" position in which the window is exposed, and a "closed" position in which the window is essentially blocked.

The elongated slats may be formed of polyurethane foam or the like. Preferably their cross section is in the form of a parallelogram to facilitate movement between the two desired alignments. The parallelogram shape enables the blinds to rotate relative to one another without interference, while at the same time enabling them to contact one another when in the closed position to form a seal to discourage convective heat losses. Mounting means including a spring biased pivot may be provided to rotatably couple the slats between the mounting members.

Importantly, the present slats may be employed with conventional pantograph louver control systems. Such control systems, which are readily available commercially, provide the benefit of enabling all of the slats to be rotated to a desired position from a relatively rigid metallic or reinforced plastic housing may be coupled over the slat members to reinforce them and to permit variance in the texture, ornamentation and/or color thereof.

Thus a broad object of the present invention is to provide a system for reducing energy losses hitherto associated with windows.

More specifically, it is an object of the present invention to provide an insulating system which may be readily adjusted between window insulating and view permitting positions.

A related object of the present invention is to provide a system of the character described which will reduce convective losses associated with conventional windows.

A further object of the present invention is to provide a readily employable system whereby energy savings may be achieved with the use of windows, which system will encourage the employment of multiple window construction.

A still further object of the present invention is to provide a system of the character described which will freely and reliably rotate between open and closed positions either by direct manual control or by conventional pantograph control.

A further object of the present invention is to provide a reinforced shell or housing for insulated slats of the character described.

Another object of the present invention is to provide a system which may be relatively easily and inexpensively employed in conjunction with windows, which system will reduce conductive, convective, and/or radiation energy losses.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout to indicate like parts in the various views;

FIG. 8 is an isometric view of an alternative preferred embodiment in which slats constructed in accordance with the teachings of the present invention are pivotally mounted between typical, conventional pantograph louver control systems;

FIG. 9 is an enlarged, sectional view of a conventional pantograph control track, taken generally along Line 9—9 of FIG. 8;

FIG. 10 is a sectional view illustrating an alternative approach for coupling a slat to a conventional pantograph control system; and FIG. 11 is a detailed, vertical sectional view illustrating typical slats disposed in a closed position.

DETAILED DESCRIPTION OF THE DRAWINGS

Figure 2:
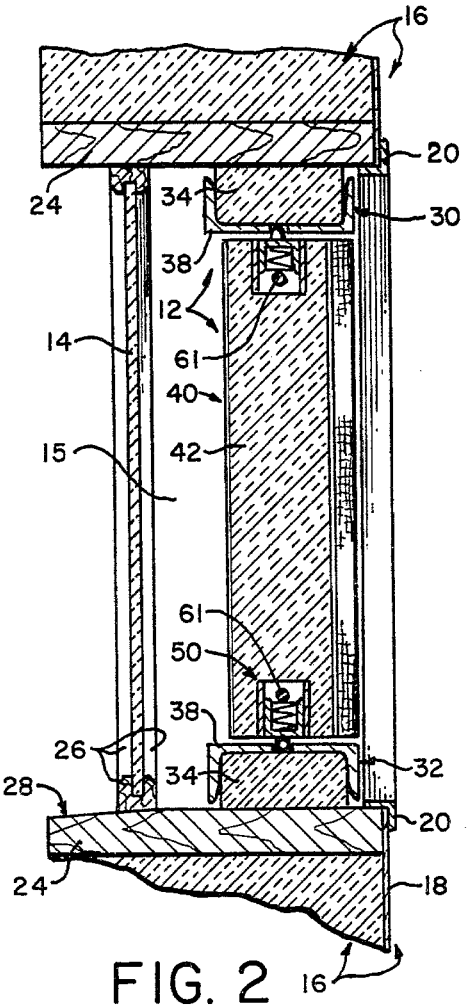
FIG. 2 is a sectional view with parts thereof broken away for clarity, the view taken generally along Line 2—2 of FIG. 1.
Figure 1:
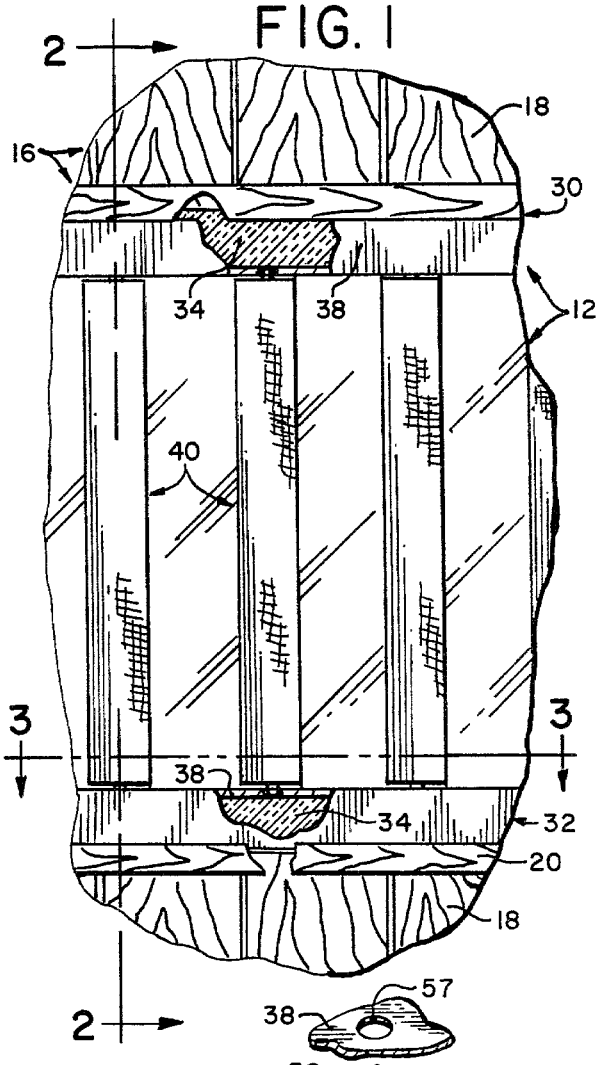
FIG. 1 is a pictorial view of a window insert constructed in accordance with the teachings of this invention and illustrating the individual insulative slats in an open position, with parts of the view broken away or shown in section for clarity.
Figure 3:
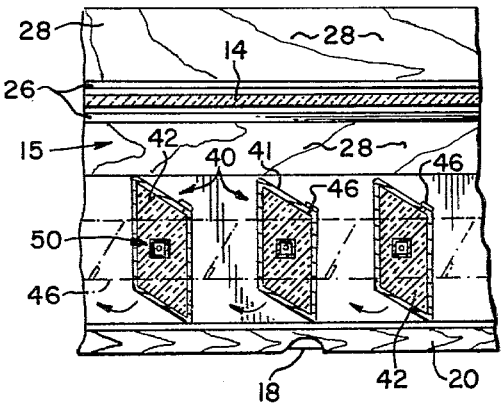
FIG. 3 is a sectional view taken generally along Line 3—3 of FIG. 1, with parts thereof broken away for clarity.

Referring initially to FIGS. 1 through 3, the preferred mode of the present invention comprises a window insert device generally designated by the reference numeral 12. Insert 12 is adapted to be placed within the conventional window sill spaced-apart from glass pane 14.

The typical wall 16 includes front paneling 18 which terminates in conventional molding 20. The top and bottom of the sill are typically comprised of conventional braces 24 between which the insert 12 is positioned. Braces 24 secure conventional mounts 26 immediately to the rear of window ledge 28 for properly retaining window pane 14.

The insert 12 preferably comprises a pair of elongated, rigid mounting members designated generally by the reference numerals 30, 32. Each of the mounting members preferably comprises an optional, foam channel 34 secured to sill 24. Elongated, rigid channel braces 38 are positioned over members 34 to provide a rigid brace for receiving slats 40 which extend therebetween.

Slats 40 preferably comprise housing 41 which substantially surrounds the insulative core 42. Core 42 may be formed of polyurethane foam or similar insulative material. It will be noted that the slats are of generally parallelogram cross section (FIG. 3), and they may be moved between the open position shown in closed lines and the closed position shown in dashed lines. When in the closed position, opposite aligned edges of the individual slat members will contact each other, and the various slats 40 will be aligned in a substantially coplanar configuration which will block pane 14 and provide an insulative effect, thus isolating intermediate region 15. Individual pieces of weather stripping 46 are sealed to the opposite edges of the slat members to provide a reliable convective seal when the slats are rotated to the closed position. It will also be apparent that if the slats were of rectangular cross section, they would not rotate reliably since individual slats would contact one another as the corners of the rectangle would strike a mutually interferring arc. As will be described in more detail hereinafter, the housing 41 may be comprised of rigid plastic, aluminum or the like.

Figure 4:
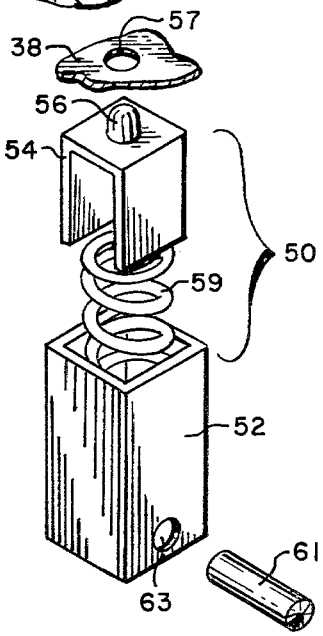
FIG. 4 is an exploded, enlarged, isometric view of the preferred pivot mount system employed to couple the slats to the mounting members.

Turning now to FIG. 4, it is contemplated that a spring biased pivot mounting system, generally designated by the reference numeral 50 may be employed. System 50 includes a tubular housing 52 of generally cubicle dimensions, which receives a plunger 54 slideably disposed therewithin. Plunger 54 includes a upper pivot pin projection 56 adapted to be received within a suitable orifice 57 provided at spaced-apart locations along the length of channel 38. Plunger 54 is normally biased to an outwardly extending position by an internal, coiled spring 59. The base or housing 52 may be secured within a suitable generally rectangular slot 62 (FIG. 5) appropriately defined within the outermost edges of the slat and secured therewithin by a conventional pin 61 which is received through suitable orifices 63 provided in the base of member 52.

Figure 5:
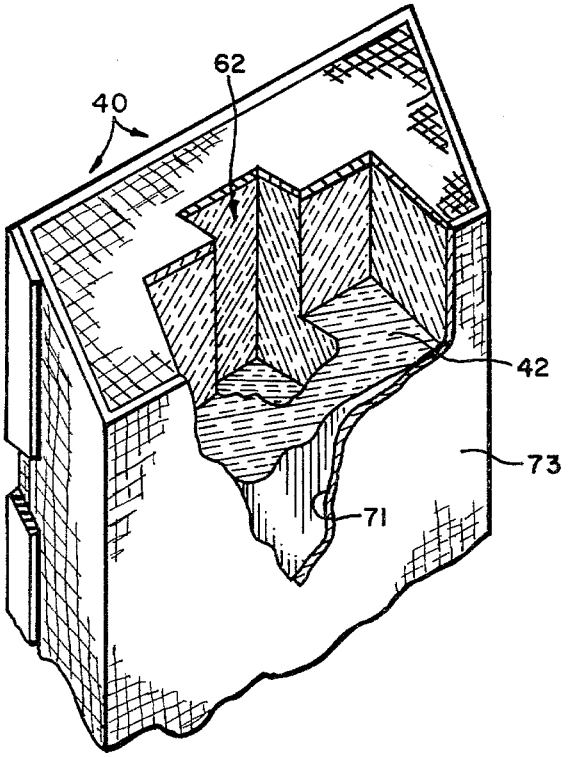
FIG. 5 is a partially cut away, isometric view of a preferred slat of the type employed in FIGS. 1–3.

In FIG. 5 the slat 40 includes an appropriate recess 62 at its center for receiving mounting system 50 (FIG. 4). The frame 71 is optional. Also, optional paint or vinyl covering 73 is applied to frame 71 to color the apparatus as desired. Covering 73 may be comprised of paint, cloth, plastic or the like.

Figure 6:
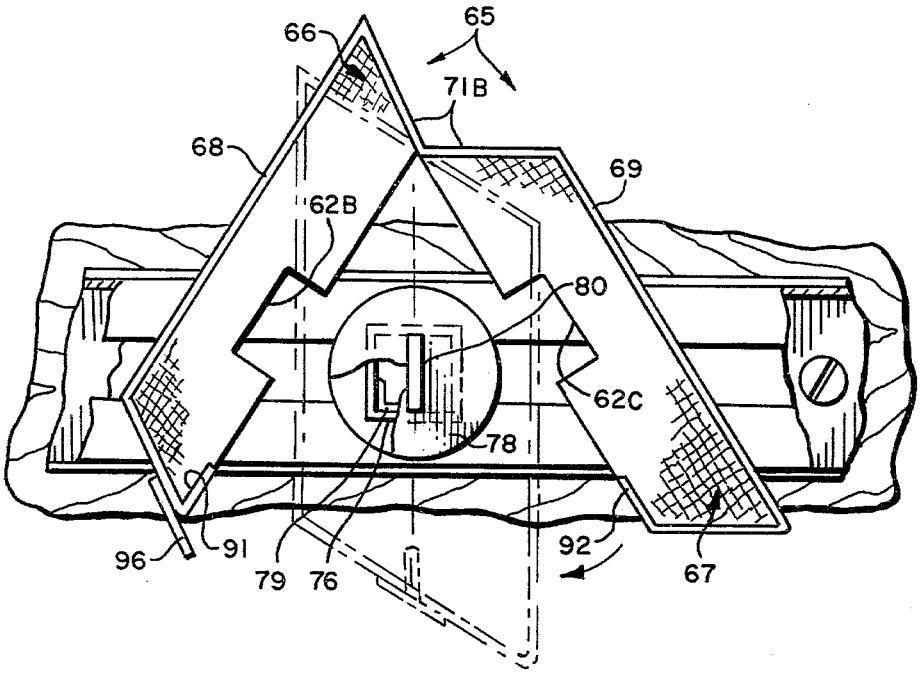
FIG. 6 is an enlarged, top plan view of an alternative slat illustrating it prior to final assembly about its preferred square tubing core.

With reference now to FIG. 6, embodiment 65 may comprise first and second halves 66, 67, which are received within the general confines of the similarly profiled housing halves 68, 69. Housing 71B preferably is comprised of a light weight semi-rigid metal such as aluminum or the like. As discussed in conjunction with FIG. 5, the outer surface of the housing 71B may be provided with a decorative paint or vinyl covering of a desired color. It will be apparent that housing halves 68, 69 are merely coupled together with orifice 62B, 62C aligned with respect to a central, elongated vertical support coupling 76 of preferably square cross section. Member 76 may extend coaxially within the mounting channel between upper and lower mounting arms. Alternatively, orifices 62B, 62C may be coupled about mounting housing 52 (FIG. 4).

Figure 7:
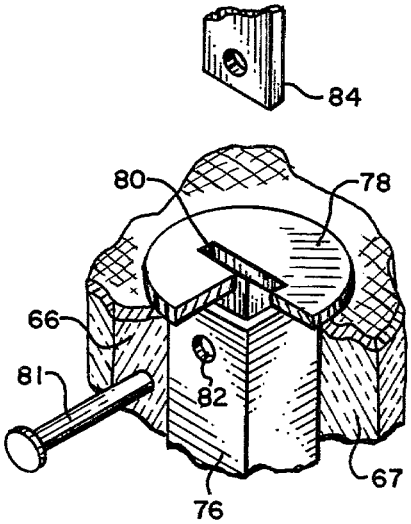
FIG. 7 is an enlarged, isometric view of a pivot mounting system adapted to be coupled to conventional pantograph control mounts, with parts thereof broken or cut away for clarity.

With reference to FIG. 7, a terminal end of central stanchion 76 is fitted with a suitable grommet 78 which includes a rigid stem 79 received within member 76 and secured therewithin by a conventional pin 81 received through appropriate apertures 82. Slot 80 receives a projection 84 extending from conventional louver pantograph mounting shown in FIGS. 8 through 10. Thus, when projection 84 is rotated, the slat controlled thereby will pivot accordingly.

It is contemplated that polyurethane foam members 66, 67 will be neatly glued within the housing halves 68, 69. Afterwards, the housing halves need merely be closed about control couplings 66 to position the apparatus such that inturned, terminal edges 91, 92 (FIG. 6) will abut as indicated in dashed lines. When the members are appropriately glued the apparatus will be secured together. It will be apparent that the seam formed by coupling the members together will be covered by a vinyl or light rubber weather stripping portion 96 which will provide a seal. Additionally, when in the closed position, the slats will align and contact adjacent edges, and the weather stripping members 96 will form a seal.

In FIG. 8, an alternative embodiment, generally designated by the reference numeral 100, includes vertical slats 102, constructed as previously described. Slats 102 extend vertically between, and are pivotally controlled by, a pair of spaced-apart pantograph louver members 104, 106. Thus, in the embodiment 100 shown generally in FIGS. 8–10, members 104, 106 correspond to the "manual" mounting members 30, 32 previously described and illustrated in FIGS. 1 through 3.

In FIG. 9 the pantograph control mechanism is illustrated. Essentially the pantograph mechanism comprises an elongated, extruded aluminum track 108 secured by a bracket 109. A pantograph spacing mechanism, generally designated by the reference numeral 110, includes carrier body 111 driven upon suitable tracks 112 by carriage wheels 114, 115. An extruded aluminum pinion gear drive shaft 118 may move individual louvers supported by downwardly projecting tab 84, which as described previously, may be coupled to a grommet 78 for lower control. The pantograph system illustrated in FIG. 9 comprises a Graber model G-71 heavy duty rotating transversing blind structure. Alternatively, the non-traversing channel generally designated by the reference numberal 130 (FIG. 10) may be employed. In this embodiment slat 102A penetrates the core square tubing 76. Member 130 comprises a Graber model ST-64 channel.

With reference now to FIG. 11, it will be appreciated that the various slats 160 rotate about centers 162, in the middle of brackets 164. By virtue of the generally parallelogram cross section of the structure, it will be apparent that each slat will clear its neighbor as it rotates. However, in the "closed" position illustrated in FIG. 11, the angled slat ends 166, 167 will be in substantially abutting relation. To this effect the previously described weather stripping 96 will form a convective seal to discourage the passage of air currents. Importantly a stationary, non-rotatable end slat 168 may be secured to the side of the window frame so that its angled edge 170 will appropriately abut the edge 172 of the rotatable, neighboring slat. End member 168 may similarly be suspended between upper and lower mounting members or channels, with, for example, internal square stanchion 178. End portion 168 may include metallic housing 183, the cross section of which is generally in the form of a trapezoid.

Thus with the prior embodiments discussed it is apparent that the window and frame in which the insert is mounted will be substantially isolated when the insert is deployed in a closed position. To this effect it will be apparent that the mutually abutting, and aligned cooperating insulated slats will generally form a protective plane which will discourage energy transmission, whether transmission is by convection, conduction or radiation. On the other hand, when it is desired to expose the window, one need merely actuate the various slats in any convenient manner.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A thermally insulative insert assembly adapted to be mounted within a window frame in spaced relation with respect to a window pane, the assembly comprising:

elongated, upper and lower pantograph mounting members adapted to be secured in generally parallel, spaced-apart relation within said window frame at top and bottom locations respectively therewithin;

a plurality of rotatable elongated slats comprised of thermally insulative material extending vertically between said upper and lower mounting members for pivotal, concurrent rotation between an open and a closed coplanar position thereby, the slats being of generally parallelogram cross section to permit rotation between said open and closed positions without interference with one another and to facilitate edgewise slat to slat sealing contact when rotated to said closed position;

stationary, non rotatable end slats forming sides of said insert and extending vertically between said upper and lower mounting members at opposite sides thereof, the end slats angularly adapted to contact the outermost angled edges of adjacent rotatable slats when said rotatable slats are moved to a closed position; and, the slats, when in a closed position, forming a flat continuous surface spaced apart from the window mounted within said frame.

* * * * *